US005829800A

United States Patent [19]

Stoltz et al.

[11] Patent Number: 5,829,800

[45] Date of Patent: Nov. 3, 1998

[54] THEFT-DETERRENT DEVICE WITH GASFLOW LOCK RELEASE

[75] Inventors: Klas Stoltz; Bo Gustavsson, both of Huddinge, Sweden

[73] Assignee: Färgkämman AB, Huddinge, Sweden

[21] Appl. No.: 721,532

[22] Filed: Sep. 26, 1996

[30] Foreign Application Priority Data

Jul. 3, 1996 [SE] Sweden ..... 9602631

[51] Int. Cl.[6] ..... B65D 33/34

[52] U.S. Cl. ..... 292/316; 292/307 R; 292/252; 29/270

[58] Field of Search ..... 292/307 R, 252, 292/307 A, 316, 323, 327; 70/57.1, 276; 24/453, 704.1, 706.8, 706.6, 108, 110; 403/15; 29/270, 281.6

[56] References Cited

U.S. PATENT DOCUMENTS

| | | | |
|---|---|---|---|
| 3,430,305 | 3/1969 | Geffner | 411/348 |
| 3,973,418 | 8/1976 | Close . | |
| 4,221,025 | 9/1980 | Martens et al. | 70/57.1 |
| 4,483,049 | 11/1984 | Gustavssosn et al. . | |
| 4,502,717 | 3/1985 | Close . | |
| 4,590,461 | 5/1986 | Cooper | 70/57.1 |
| 4,722,119 | 2/1988 | Green | 292/316 |
| 4,884,833 | 12/1989 | Pedersen | 292/316 |

FOREIGN PATENT DOCUMENTS

| | | | |
|---|---|---|---|
| 443886 | 3/1986 | Sweden . | |
| 734988 | 8/1955 | United Kingdom | 411/348 |
| 93006582 | 4/1993 | WIPO | 292/307 R |

*Primary Examiner*—Rodney M. Lindsey
*Attorney, Agent, or Firm*—Browdy and Neimark

[57] ABSTRACT

The invention relates to a theft-deterrent device which is intended to be attached to and locked on theft-attractive goods (10) and which is constructed to coact with a device release means (8) for release of the device from said goods. The theft-deterrent device includes a first unit (2) which comprises a base element (3) and a connecting element (4) which projects out from the base element and which is intended for insertion through the goods (10), and a second unit in the form of a locking element (6) which is intended to be placed on the connecting element (4) and locked to said element against movement in a direction away from the base element (3) so as to secure the device firmly to said goods (10). The locking element (6) is constructed for release from the connecting element (5) by the action of a gasflow delivered to the locking element (6). The invention also relates to a locking element (6) for a theft-deterrent device, and to a theft-deterrent device release means (8).

20 Claims, 3 Drawing Sheets

THEFT-DETERRENT DEVICE WITH GASFLOW LOCK RELEASE

Figure 1:
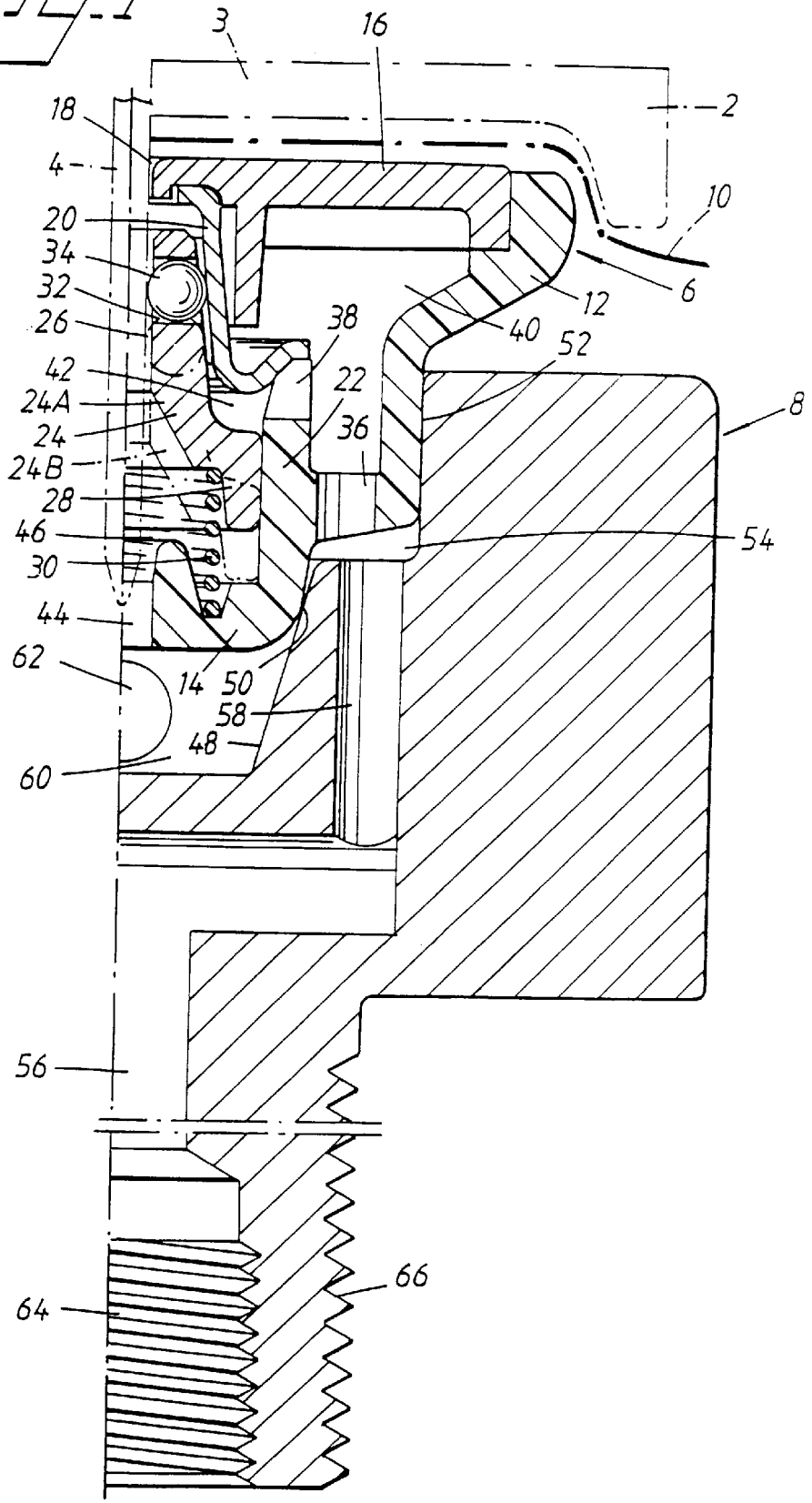

The present invention relates to a theft-deterrent device which is intended to be placed on and locked to a theft-attractive item of goods and which is constructed to coact with a device release means to release the theft-deterrent device from said goods. The theft-deterrent device includes a first unit which comprises a base element and a connecting element that projects out from the base element and is intended to be inserted through said goods, and a second unit in the form of a locking element which is intended to be placed on the connecting element and locked thereto against movement in a direction away from the base element, so as to firmly secure the theft-deterrent device to the goods. The invention also relates to a theft-deterrent device locking element, and to a theft-deterrent device release means.

Theft deterrents of this kind are used to prevent or deter theft of theft-attractive articles, such as clothing, bags, handbags, suitcases and the like, and other retail goods that can be easily carried. A device of this kind is intended to be attached to the article in such a manner that the device can only be released with the aid of a special release means, it being assumed that such means are unavailable to potential thieves. An attempt to remove the theft-deterrent device without using the special release means will cause the goods to be rendered practically unusable, either as a result of being torn in the attempt, or by causing a fragile ampul that contains a marking substance and housed in said device to fracture or burst and therewith release the marking substance and staining the goods or damaging the goods in some other way. The theft-deterrent device may also carry an alarm element forming part of an alarm system either as an alternative or complementary to one or more marking substance containing ampuls, said alarm system being triggered by a sensor arrangement at the exits of the store in which the theft-attractive goods are offered for sale.

Normally, theft-deterrent devices of the kind defined in the introduction have locking elements which can be released with the aid of magnetic forces. Subsequently, so-called pirate magnets have been developed and used with some success to release the locking element unlawfully from the connecting element and therewith the theft-deterrent device from said goods.

A theft-deterrent device that includes a locking element which can be released with the aid of compressed air is known to the art from U.S. Pat. No. 4,502,717. The theft-deterrent device described in this patent publication includes a locking element that is provided with a chamber which is delimited from remaining parts of the element in pressure-tight fashion, through the medium of a flexible diaphragm. When compressed air is delivered through a connection opening to the pressure-tight chamber so as to generate an overpressure, the locking element is released by indirect transfer of diaphragm movement. It will readily be seen that the device according to U.S. Pat. No. 4,502,717 can be released by an unauthorized person without much difficulty. The diaphragm is actuated by a pressure surge which can be readily generated from a lightweight compressed-air source, by connecting a simple nozzle in the inlet opening.

The object of the present invention is to provide a theft-deterrent device in which a highly secure locking function against unauthorized or unlawful release of the device has been incorporated without rendering the device structurally complicated and therefore expensive to produce.

This object is achieved in accordance with the invention with a theft-deterrent device, a theft-deterrent device locking element, and a theft-deterrent device release means having the characteristic features set forth in respective Claims.

Figure 2:
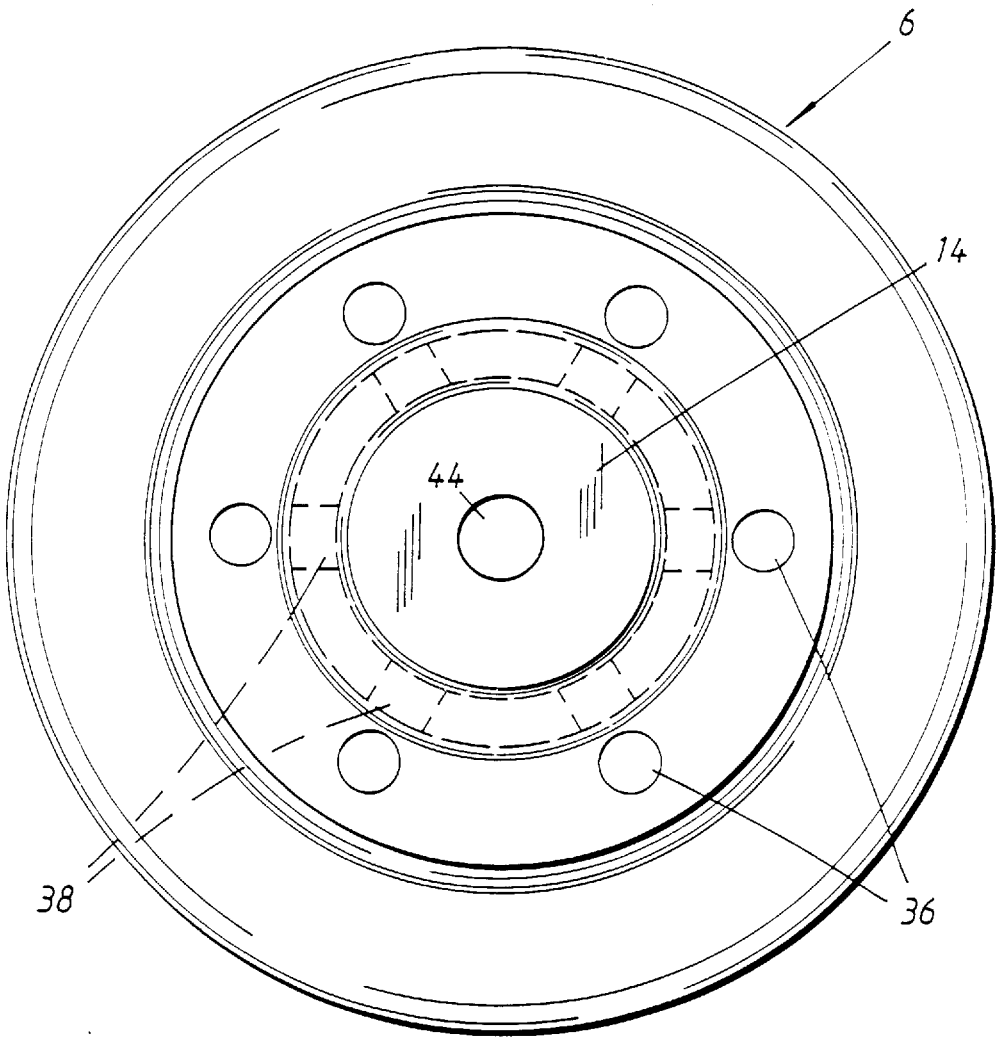
Figure 3:
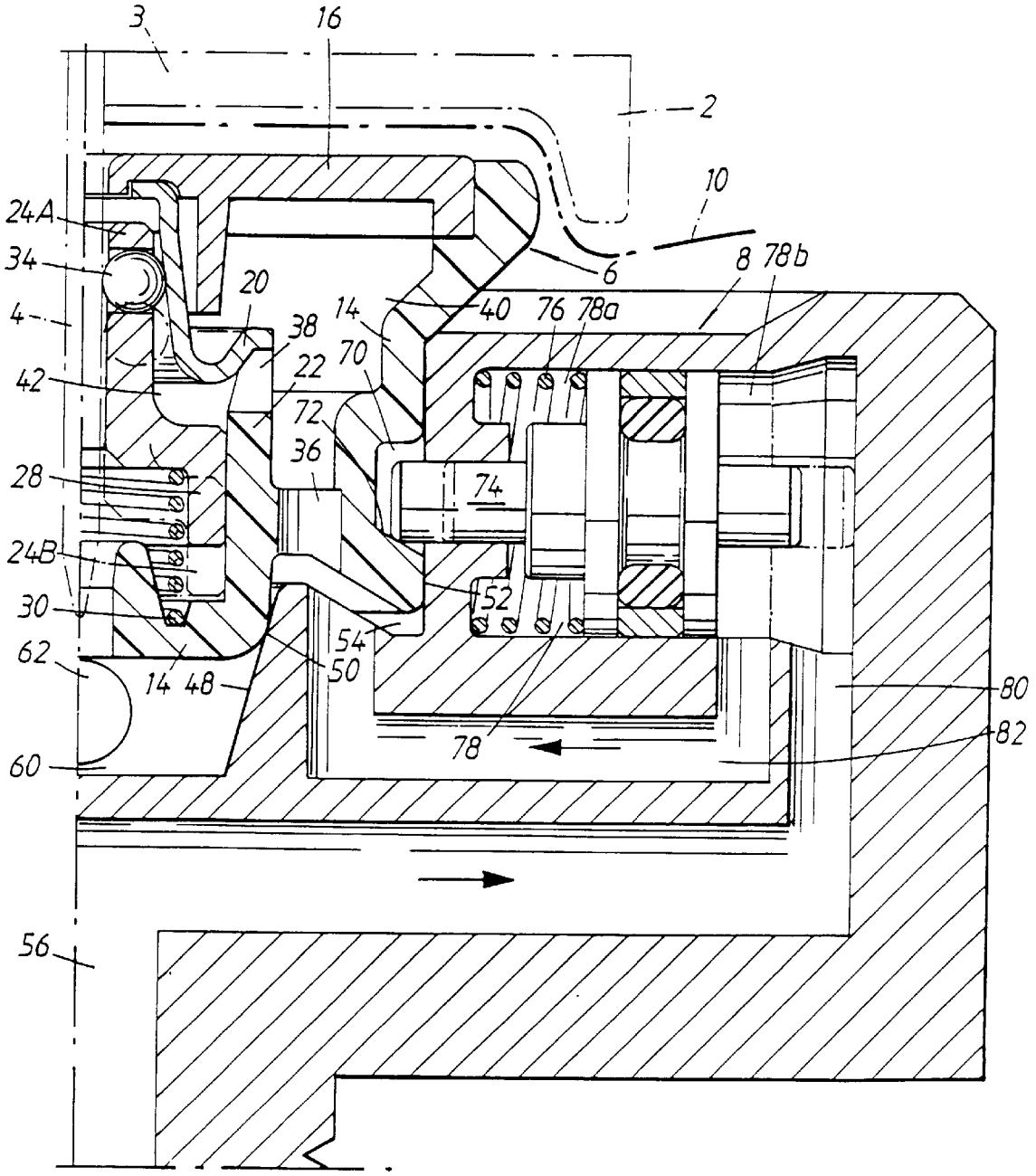

The invention will now be described in more detail with reference to the accompanying drawings, in which FIG. 1 is a sectional view of a theft-deterrent device in coaction with a device release means in accordance with a first embodiment of the invention;

FIG. 2 shows the theft-deterrent device of FIG. 1 from beneath, without the release means; and FIG. 3 illustrates a second embodiment of the invention in the same way as in FIG. 1.

The inventive theft-deterrent device is comprised of two units, viz a first unit 2 which includes a base element 3 and an elongated connecting element 4 which projects out from the base element, and a second unit in the form of a locking element 6. The connecting element 4 is intended to be passed through the item of goods 10 to be protected, whereafter the second unit 6, the locking element, is placed on and locked to the connecting element 4. The locking arrangement can be made inoperative with the aid of a special device release means 8, so as to enable the two units 2, 6 to be released from one another and from the goods 10.

One or both of the two units 2, 6 may include one or more marking substance ampuls (not shown in the FIGS.)which are intended to break if an attempt is made to release the theft-deterrent device without using the special release means and therewith release the marking substance enclosed in the ampul and stain said goods or damage the goods in some other way. The units may also include an alarm element or elements for coaction with an electronic alarm system instead of the marking substance ampuls or as a complement thereto. It will also be understood that the locking element or unit 6 can be used solely as a locking element without being provided with a marking substance ampul or an alarm element.

FIG. 1 is a cross-sectional view which shows part of the theft-deterrent device 2, 6 and the release means 8 coacting with said device, in accordance with a first embodiment of the invention. In the FIG. 1 embodiment, the device and the release means are mirror-symmetrical around the centre line, and consequently only half of the cross-section is shown in the Figure. The Figure shows the second unit, the locking element 6, into which a connecting element 4 has been inserted and locked thereto. The first unit 2 and the item of goods 10 through which the connecting element 4 has been passed are shown only schematically in FIG. 1.

The locking element 6 will preferably have the form of a circular lock housing 12 which comprises a bottom part 14 and a cover part 16 connected permanently thereto, i.e. welded thereto or affixed in some other way. The lock housing parts are preferably made of a plastic material. The lock housing 12 includes a connecting-element insertion opening 18 in the centre of the cover part 16.

A generally conical sleeve 20, preferably a metal sleeve, is mounted in the lock housing 12 between the cover part 16 and the bottom part 14. The circular base part of the sleeve 20 rests on the upper edge of an inner cylinder 22 formed in the bottom part 14. A holder 24 having a central hole 26 for receiving the connecting element 4 is displaceably arranged in the conical sleeve 20 and the cylinder 22. The holder may be made of aluminium or plastic for instance, so as not to be affected by magnetic forces. One end-part of the holder forms a ring-shaped flange 28 which abuts the inner wall of the cylinder 22 and slides against said wall as the holder is displaced. A spring means 30 is provided between the holder 24 and said bottom part 14, and the holder 24 is urged in a direction towards a first position 24A by the spring means 30, as shown in full lines in FIG. 1.

The upper part of the holder 24 includes one or more through-penetrating holes 32 in which movable locking means 34 are arranged. The locking means 34 have the form of balls, preferably metal balls, whose diameters exceed the wall thickness of the holder. With the connecting element 4 inserted into the locking element 6, as shown in FIG. 1, the locking means 34 are pressed firmly against the connecting element 4 and therewith lock the same. When attempting to pull the first unit 2 and the connecting element 4 from the locking element or second unit 6, the locking force acting on the locking means 34 will increase by virtue of coaction with the conical sleeve 20, so as to firmly clamp and lock the connecting element 4. The locking means 34 will not, on the other hand, prevent movement of the connecting element 4 into the locking element 6.

The bottom part 14 of the lock housing is provided with inlet openings 36 which connect the surroundings with an outer chamber 40 disposed in the lock housing and located outwardly of the conical sleeve 20 and the inner cylinder 22. The cylinder wall 22 is also provided with a plurality of inlet openings 36 that connect the outer chamber 40 with an intermediate chamber 42 located between the conical sleeve 20, the cylinder 22 and the holder 24. The lock housing 12 also includes one or more openings which is/are placed centrally and forms/form an evacuation opening or openings 44 that connects/connect an inner chamber 46 with the surroundings, said inner chamber being located between the holder 24 and the bottom part 14 of the lock housing.

FIG. 2 shows the locking element 6 of FIG. 1 from beneath. In the illustrated embodiment, the locking element 6 includes six inlet openings 36 which are placed symmetrically and equidistantly around the bottom part 14 of said lock housing. The bottom part 14 is also provided with an evacuation opening 44 placed in the bottom part 14 between the inlet openings 36. Each of the inlet openings 36 has a size which will allow a flow of gas to enter which in itself is insufficient to generate the force required to displace the holder 24. In order to displace the holder 24, it is thus necessary to deliver a gasflow to more than one of the inlet openings 36. Adjacent each inlet opening 36 is a corresponding opening 38 which provides a connection from the inlet opening 36 via the outer chamber 40 and through the opening 38 into the intermediate chamber 42 (see FIG. 1).

The locking arrangement in the locking element or unit 6 can be placed in a release mode by means of a release means 8 which fits the theft-deterrent device and which is shown in FIG. 1 together with the locking element 6. The release means 8 has a seating 48 into which the bottom part 14 of the lock housing can be inserted for releasing the locking arrangement. The seating 48 has abutment surfaces 50, 52 which seat generally sealingly against the full circumference of the bottom part on both sides of the inlet openings 36. The shape of the seating 48 in the region between the abutment surfaces 50, 52 deviates from the shape of the bottom part 14 such as to form an annular chamber 54 between the release means 8 and the lock housing 12. The shape of the seating 48 also deviates from the shape of the bottom part 14 in a region inwardly of the inner annular abutment surface 50, such as to form an intermediate evacuation chamber 60 between the bottom part 14 and the release means 8. The evacuation chamber 60 communicates with the surroundings through one or more evacuation passageways 62 in the release means 8.

The release means 8 has one or more outer passageways 58 which open into the pre-chamber 54 adjacent the inlet openings 36 in the lock housing. The outer passageways 58 connect with a centrally located inner passageway 56 which is common to all outer passageways 58 and the outer part 64 of which is configured to receive a connection to a source of gasflow. The release means 8 is also provided with fastener means, e.g. external screw threads which together with a nut are intended to anchor the release means permanently to a pay counter or the like.

When an item of goods has been paid for and a receipt has been issued, the theft-deterrent device is released from said item by placing the locking element 6 in the seating 48 of the release means 8 in the manner shown in FIG. 1. As before mentioned, the release means 8 is, e.g., firmly anchored to a pay counter or the like and is connected to a gas supply, such as air or some other suitable gas. The supply of air or gas to the release means can be controlled with the aid of a valve, which may be a foot-operated valve and accessible only to a cashier, for instance.

Upon activation of the release means 8, air or some other suitable gas is led into the inner passageway 56 and branches out into the outer passageway 58 from which it passes through the inlet openings 36 in the housing 12, via the annular pre-chamber 54, and then into the openings 38 and into the intermediate chamber 42, via the outer chamber 40. Thus, the gas flows at a high speed into the intermediate chamber 42 while at the same time the gas flows to a limited extent, or leaks, from the intermediate chamber 42 partly through the narrow space between the holder 24 and the conical sleeve 20 and partly through the holes 32 and also between the annular flange 28 and the cylinder wall 22. When the gas flow into the intermediate chamber 42 is sufficiently large to replace the leakage flow and to overcome the spring force of the spring means 30, the holder 24 will be moved to its second position 24B (shown in broken lines in FIG. 1). The air in the inner chamber 46 and the leakage flow or outflow are evacuated through the evacuation opening 44, through the evacuation chamber 60 and from there through the evacuation passageway 62 and out to the surroundiong atmosphere. As the holder 24 moves in the conical sleeve 20, the locking means 34 are moved sideways, therewith causing the pressure exerted by the locking means 34 on the connecting element 4 to cease. The unit 2 can therewith be released from the locking element 6 and also from the goods 10.

Thus, in order for the holder 24 to be moved effectively to the release position, the gasflow must be sufficiently large to counteract the spring force exerted by the spring means 30 and to continuously compensate for the leakage flow. In order to obtain and maintain a gasflow in the locking element 6, it is necessary for evacuation to take place on the rear side of the holder 24, since otherwise pressure would immediately build up in the inner chamber 46 and result in a counterpressure on the holder 24, and therewith block movement of the holder.

It will be realized that construction of pirate equipment capable of fulfilling these requirements would be extremely difficult to achieve. A gas supply source is both bulky and easily identifiable in a retail store. With the evacuation opening 44 placed inwardly of and between the inlet openings 36, it is extremely difficult to fabricate a pirate nozzle which alone is able to ensure sufficient gasflow and evacuation at the same time, as will readily be understood.

FIG. 3 is a cross-sectional view of an alternative embodiment of the invention, similar to the FIG. 1 illustration. Similar to the FIG. 1 illustration, the theft-deterrent device and the release means in FIG. 3 are mirror-symmetrical around the centre line, and consequently only one-half of the cross-section is shown in the Figure.

The locking element 6 of the FIG. 3 embodiment differs from the locking element of the FIG. 1 embodiment essentially in that the bottom part 14 of the lock housing 12 is provided with a peripherally extending locking groove 70. The locking groove 70 has an oblique lower locking surface 72 which coacts with a displaceable locking plunger 74 in the release means 8, as described below. The locking plunger 74 is arranged displaceably in a chamber 78 and is in a non-active position retracted and inserted into the release means 8 by the pressure of a spring 76, as shown by a chain line in FIG. 3. The locking plunger 74 divides the chamber 78 into two essentially gas-tight parts 78*a*, 78*b*. A supply passageway 80 connects the chamber part 78*b* with the inner passageway 56 of the release means. An intermediate passageway 82 connects the chamber 78 with the annular pre-chamber 54 located between the abutment surfaces 50, 52.

When activating the release means 8 of the FIG. 3 embodiment, gasflow is supplied to the chamber part 78*b* through the inner passageway 56 and the supply passageway 80. A power build-up takes place in the chamber part 78*b*, causing the plunger 74 to be moved into the locking groove 70 against the pressure of the spring 76. In this position, the locking plunger 74 (together with the mirror-image locking plunger not shown in FIG. 3) locks the theft-deterrent device to the seating 48 of the release means. The force exerted by the locking plunger 74 against the oblique locking surface 72 generates a vertical force component which urges the locking element 6 towards and against the seating 48 of the release means, therewith increasing the sealing effect achieved with the abutment surface 50.

As the locking plunger 74 is moved into the locking groove 70, the connection between the chamber part 78*b* and the intermediate passageway 82 is opened and air, or some other gas that may be used, flows through the passageway 82, through the pre-chamber 54 and into the inlet openings 36 of the locking element, from where it continues in the same way as that described with reference to FIG. 1.

When the release means is activated and sufficient gasflow is delivered, the theft-deterrent device is locked in the release means in a first stage of operation, and then, and only then, the locking element 6 is released from the connecting element 4 in a second stage of operation. The first element or unit 2 is therewith released and can be lifted from the locking element or second unit 6 and from the goods 10. The gasflow can then be throttled, whereupon the spring 76 presses back the locking plunger 74 so as to enable the locking element 6 to be removed from the release means 8.

It will be understood that the invention is not restricted to the aforedescribed exemplifying embodiment thereof and that several modifications are conceivable within the scope of the following Claims. For instance, although the locking means have been described as being ball-shaped, said means may, of course, have other suitable shapes and may vary in number from one and upwards. The number of inlet openings, evacuation openings, other openings, locking plungers and the different passageways may also vary in number and positions. The holder provided with the movable locking means may also be fixedly mounted in the lock housing and the conical sleeve that coacts with said locking means may, instead, be movable in response to a gasflow delivered to a chamber in the locking device on one side of the displaceable sleeve.

In another alternative embodiment, the cylindrical inlet openings 36 are replaced with one or more elongated and part-circular or generally kidney-shaped inlet openings. In this embodiment, each opening will permit the through-passage of sufficient gasflow to move the holder to its release position. The evacuation opening is conveniently placed between the inlet openings in the same manner as that described above with reference to the other embodiments, or may alternatively be placed inwardly of the part-circular or kidney-shaped inlet opening when only one inlet opening is provided. It will be understood that the construction of a locking element release device would also be difficult to achieve in this case.

We claim:

1. A theft-deterrent device intended to be attached to and locked on theft-attractive goods and constructed to coact with a release means for releasing the device from said goods, wherein the device includes a first unit (2) comprising a base element (3) and a connecting element (4) which projects out from the base element and which is intended for insertion through said goods (10), and a second unit in the form of a locking element (6) which is intended to be fitted onto the connecting element and locked thereto against movement in a direction away from the base element (3) such as to secure the theft-deterrent device to the item of goods (10), characterized in that the locking element (6) is constructed for release from the connecting element (4) through the action of a gasflow delivered to the locking element (6), the gasflow including an outflow, whereby the gasflow passes through the locking element (6).

2. A device according to claim 1, characterized in that the locking element (6) includes a lock housing (12) having a first and a second chamber (40, 42; 46) which are separated by a displaceable holder (24) which coacts with locking means (34) such as to lock the connecting element (4), wherein the holder (24) is arranged to take a first position (24A) in which the locking means (34) lock the connecting element (4) and to be moved by the action of a gasflow delivered to the first chamber (40, 42) to a second position (24B) in which the locking means (34) are released from the connecting element (4).

3. A device according to claim 2, characterized in that the lock housing (12) is provided with at least one inlet opening (36) for delivering gasflow to the first chamber (40, 42), and with at least one evacuation opening (44) for evacuation of the second chamber (46).

4. A device according to claim 3, characterized in that the holder (24) is disposed in the lock housing (12) so that an outflow of supplied gas takes place from the first chamber (40, 42).

5. A device according to claim 2, characterized in that the locking means (34) are arranged displaceably in the holder (24) and coact with a conical sleeve (20) fixedly mounted in the lock housing (12), such as to lock the connecting element (4).

6. A device according to claim 2, characterized in that the holder (24) is arranged to be moved from the first position (24A) to the second position (24B) against the pressure of a spring means (30).

7. A device according to claim 3, characterized in that the lock housing (12) has at least two inlet openings (36) for the delivery of gasflow to the first chamber (40, 42), and in that the evacuation opening (44) is disposed between the inlet openings (36).

8. A device according to claim 7, characterized in that each of the inlet openings (36) has a size which allows therethrough a gasflow which is smaller than the flow required to release the locking element (6) from the connecting element (4).

9. A device according to claim 3, characterized in that the lock housing (12) is provided with an elongated, part-circular or generally kidney-shaped inlet opening (36) and in that said evacuation opening (44) is disposed on an inside of the inlet opening.

10. A locking unit for a theft-deterrent device intended to be attached to and locked on theft-attractive goods and including a first unit (2) comprising a base element (3) and a connecting element (4) which projects out from the base element, and a locking unit (6), wherein the locking unit (6) is intended to be placed on the connecting element (4) and locked thereto against movement in a direction away from the base element (3) so as to secure the device firmly on the goods to be protected, characterized in that the locking element (6) is constructed for release from the connecting element (4) through the action of a gasflow delivered to said locking element (6), the gasflow including an outflow, whereby the gasflow passes through the locking element (6).

11. A locking unit according to claim 10, characterized in that said unit includes a lock housing (12) having a first and a second chamber (40, 42; 46) which are separated by a displaceable holder (24) which coacts with locking means (34) such as to lock said connecting element (4), wherein the holder (24) is arranged to take a first position (24A) in which the locking means (34) lock the connecting element (4) and to be moved by the action of a gasflow delivered to the first chamber (40, 42) to a second position (24B) in which the locking means (34) is released from the connecting element (4).

12. Means for releasing a theft-deterrent device according to claim 1, characterized in that the release means includes a seating (48) which is constructed to receive the locking element (6) of the theft-deterrent device, at least one supply passageway (56, 58; 56, 80, 78*b*, 82) provided in the seating (48) for delivery of a gasflow to and through the locking element (6), and at least one passageway (60, 62) provided in the seating (48) for the evacuation of gas from the locking element (6).

13. Means according to claim 12, characterized in that said means includes at least one displaceable locking plunger (74) which is configured to engage a locking groove (70) provided in the locking element (6) in the locking position of said plunger, therewith to lock the theft-deterrent device in the seating (48).

14. Means according to claim 13, characterized in that the locking plunger (74) is moved to and held in its locking position by the action of a gasflow delivered to said supply passageway (56, 80, 82).

15. Means according to claim 14, characterized in that the locking plunger (74) is configured to block the supply passageway (56, 80, 82) in its position in which it is unaffected by a gasflow, and to open the supply passageway (56, 80, 82) in its gasflow actuated locking position.

16. A device according to claim 4, characterized in that the locking means (34) are arranged displaceably in the holder (24) and coact with a conical sleeve (20) fixedly mounted in the lock housing (12), such as to lock the connecting element (4).

17. A device according to claim 16, characterized in that the holder (24) is arranged to be moved from the first position (24A) to the second position (24B) against the pressure of a spring means (30).

18. Means for releasing a theft-deterrent device according to claim 17, characterized in that the release means includes a seating (48) which is constructed to receive the locking element (6) of the theft-deterrent device, at least one passageway (56, 58; 56, 80, 78*b*, 82) provided in the seating (48) for delivery of a gasflow to the locking element (6), and at least one passageway (60, 62) provided in the seating (48) for the evacuation of gas from the locking element (6).

19. Means according to claim 18, characterized in that said means includes at least one displaceable locking plunger (74) which is configured to engage a locking groove (70) provided in the locking element (6) in the locking position of said plunger, therewith to lock the theft-deterrent device in the seating (48).

20. Means for releasing a theft-deterrent device according to claim 8, characterized in that the release means includes a seating (48) which is constructed to receive the locking element (6) of the theft-deterrent device, at least one passageway (56, 58; 56, 80, 78*b*, 82) provided in the seating (48) for delivery of a gasflow to the locking element (6), and at least one passageway (60, 62) provided in the seating (48) for the evacuation of gas from the locking element (6).

* * * * *